US009851673B2

(12) United States Patent
Arai

(10) Patent No.: US 9,851,673 B2
(45) Date of Patent: Dec. 26, 2017

(54) IMAGE FORMING SYSTEM AND IMAGE FORMING METHOD

(71) Applicant: Konica Minolta, Inc., Tokyo (JP)

(72) Inventor: Hiroyuki Arai, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/492,512

(22) Filed: Apr. 20, 2017

(65) Prior Publication Data

US 2017/0308014 A1 Oct. 26, 2017

(30) Foreign Application Priority Data

Apr. 22, 2016 (JP) ..... 2016-086316

(51) Int. Cl.
*G03G 15/16* (2006.01)
*G03G 15/00* (2006.01)

(52) U.S. Cl.
CPC ..... *G03G 15/5054* (2013.01); *G03G 15/1605* (2013.01)

(58) Field of Classification Search
CPC .. G03G 7/0093; G03G 15/0882; G03G 15/16; G03G 15/1605; G03G 15/1665; G03G 15/2042; G03G 15/2053; G03G 15/224; G03G 15/225; G03G 15/5079; G03G 15/55; G03G 15/553; G03G 15/758; G03G 21/1832
See application file for complete search history.

(56) References Cited

U.S. PATENT DOCUMENTS

2013/0293929 A1* 11/2013 Kakutani ..... H04N 1/00005 358/3.24
2016/0097996 A1* 4/2016 Gilan ..... B44C 1/1729 101/227

FOREIGN PATENT DOCUMENTS

JP 2013-238733 A 11/2013

* cited by examiner

*Primary Examiner* — Roy Y Yi
(74) *Attorney, Agent, or Firm* — Osha Liang LLP

(57) ABSTRACT

An image forming system for transferring foil onto an image to be foil-pressed formed by a toner to perform foil pressing print includes: an image forming unit that forms a normal image or the image to be foil-pressed on a recording material; an operation reception unit that receives an operation of selecting a foil pressing mode of causing the image forming unit to form the image to be foil-pressed or a normal mode for causing the image forming unit to form the normal image; an image data analysis unit that analyses the image data and acquiring the amount of each toner; and a determination unit that determines whether to interrupt the image forming operation. When the amount of toner not used for the image to be foil-pressed is a predetermined first threshold or more, the determination unit determines to interrupt the image forming operation.

23 Claims, 9 Drawing Sheets

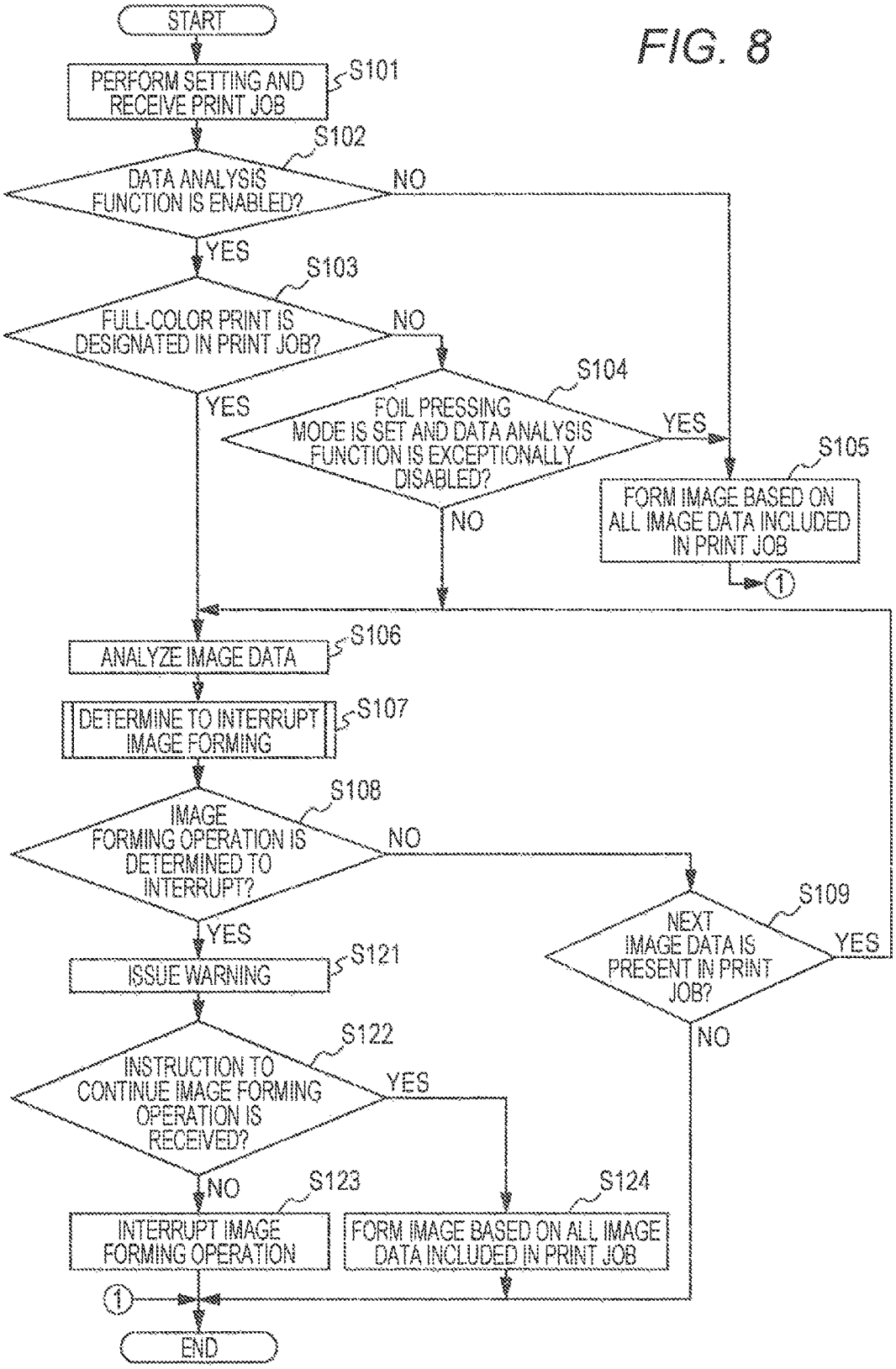
FIG. 8
START
PERFORM SETTING AND RECEIVE PRINT JOB
S101
S102
DATA ANALYSIS FUNCTION IS ENABLED?
NO
YES
S103
FULL-COLOR PRINT IS DESIGNATED IN PRINT JOB?
NO
YES
S104
FOIL PRESSING MODE IS SET AND DATA ANALYSIS FUNCTION IS EXCEPTIONALLY DISABLED?
YES
NO
S105
FORM IMAGE BASED ON ALL IMAGE DATA INCLUDED IN PRINT JOB
1
S106
ANALYZE IMAGE DATA
S107
DETERMINE TO INTERRUPT IMAGE FORMING
S108
IMAGE FORMING OPERATION IS DETERMINED TO INTERRUPT?
NO
YES
S109
NEXT IMAGE DATA IS PRESENT IN PRINT JOB?
YES
NO
S121
ISSUE WARNING
S122
INSTRUCTION TO CONTINUE IMAGE FORMING OPERATION IS RECEIVED?
YES
NO
S123
INTERRUPT IMAGE FORMING OPERATION
S124
FORM IMAGE BASED ON ALL IMAGE DATA INCLUDED IN PRINT JOB
1
END

IMAGE FORMING SYSTEM AND IMAGE FORMING METHOD

The entire disclosure of Japanese Patent Application No. 2016-086316 filed on Apr. 22, 2016 including description, claims, drawings, and abstract are incorporated herein by reference in its entirety.

BACKGROUND

Technical Field

The present invention relates to an image forming system and an image forming method.

Description of the Related Art

In recent years, it is more important to output not only conventional color images but also high-value added printed materials in an image forming system. For example, there has been known a foil pressing print technique for forming a foil image by transferring foil on a sheet by use of a toner image formed on the sheet as an adhesive in order to increase added value of the printed material (see JP 2013-238733 A, for example).

In order to perform the foil pressing print, the image forming system forms an image to be foil-pressed by a toner as adhesive by use of common units with units for forming a normal color image. The image forming system employs the common units, and thus a user needs to change a print mode when switching between normal print and foil pressing print.

There may be caused, in the image forming system, a situation that foil is erroneously pressed and output onto a normal image or an image to be foil-pressed is output without foil when a user forgets to change a print mode or erroneously performs the change operation. When foil is erroneously pressed onto a normal image to be output, expensive foil is uselessly consumed.

Particularly under an environment in offices, an image forming system is generally connected to a plurality of terminals via a network, and receives a plurality of print jobs from a plurality of users to perform printing. It is assumed that a user changes the print mode from a foil pressing print mode to a normal print mode in such an image forming system. It is further assumed that other user who wants the foil pressing print does not know the fact and transmits a print job including image data to be foil-pressed to the image forming system. In this case, the image forming system outputs a printed material which is not pressed with the other user-intended foil. Thus, the other user needs to set the foil pressing print mode and to transmit the image data to be foil-pressed again in order to acquire a desired printed material. In other words, the other user needs to perform printing again.

Similarly, there may be caused a situation that one user changes the print mode from the normal print mode to the foil pressing print mode and other user who wants the normal print does not know the fact and transmits a print job including normal image data to the image forming system. In this case, the image forming system outputs a printed material pressed with the other user-unintended foil. Thus, the image forming system forces the other user to perform printing again, which causes expensive foil to be uselessly consumed.

SUMMARY one or more embodiments of the present invention provide an image forming system and an image forming method for preventing useless printing caused by an unintentionally-set print mode in the image forming system capable of foil pressing print.

One or more embodiments of the present invention provide the following.

According to one or more embodiments, an image forming system for transferring foil onto an image to be foil-pressed formed by a toner thereby to perform foil pressing print comprises: an image forming unit capable of forming a normal image or the image to be foil-pressed on a recording material by use of at least one of a plurality of toners on the basis of image data; an operation reception unit capable of receiving an operation of selecting a foil pressing mode of causing the image forming unit to form the image to be foil-pressed or a normal mode for causing the image forming unit to form the normal image; an image data analysis unit capable of analyzing the image data and acquiring the amount of each toner used for forming an image based on the image data; and a determination unit configured to determine whether to interrupt the image forming operation based on the image data on the basis of the amount of each used toner acquired by the image data analysis unit, wherein when the amount of toner not used for the image to be foil-pressed is a predetermined first threshold or more on the basis of the amount of each used toner acquired by the image data analysis unit in the foil pressing mode, the determination unit determines to interrupt the image forming operation based on the image data.

According to one or more embodiments, the predetermined first threshold can be set per toner not used for the image to be foil-pressed.

According to one or more embodiments, when the amount of toner used for the image to be foil-pressed is a predetermined second threshold or less on the basis of the amount of each used toner acquired by the image data analysis unit in the foil pressing mode, the determination unit determines to interrupt the image forming operation based on the image data.

According to one or more embodiments, when the amount of toner used for the image to be foil-pressed is a predetermined third threshold or more on the basis of the amount of each used toner acquired by the image data analysis unit in the normal mode, the determination unit determines to interrupt the image forming operation based on the image data.

According to one or more embodiments, when the amount of toner not used for the image to be foil-pressed is a predetermined fourth threshold or less on the basis of the amount of each used toner acquired by the image data analysis unit in the normal mode, the determination unit determines to interrupt the image forming operation based on the image data.

According to one or more embodiments, the predetermined fourth threshold can be set per toner not used for the image to be foil-pressed.

According to one or more embodiments, the operation reception unit can receive a user operation of selecting whether to cause the image data analysis unit to analyze the image data, and when the operation reception unit selects not causing the image data analysis unit to analyze the image data, the image data analysis unit does not analyze the image data.

According to one or more embodiments, when selecting causing the image data analysis unit to analyze the image data, the operation reception unit can receive a user operation of further selecting whether to cause the image data analysis unit to exceptionally analyze the image data only when the foil pressing mode is set and single-color print or monochrome print is designated for the image data, and when the operation reception unit selects not causing the image data analysis unit to analyze the image data for which single-color print or monochrome print is designated, the image data analysis unit exceptionally does not analyze the image data for which single-color print or monochrome print is designated.

According to one or more embodiments, in the foil pressing mode, when full-color print is designated for the image data, the image data analysis unit analyzes the image data, and when single-color print or monochrome print is designated for the image data, the image data analysis unit does not analyze the image data.

According to one or more embodiments, when the image data analysis unit does not analyze the image data, the image forming unit forms an image based on the image data.

According to one or more embodiments, the determination unit further includes a warning unit configured to issue a warning including warning display to a user when determining to interrupt the image forming operation based on the image data.

According to one or more embodiments, the warning display includes display as to whether the foil pressing mode is set, and display of at least one of a file name including the image data and thumbnail display of the image data.

According to one or more embodiments, the operation reception unit can receive a user instruction to select whether to continue the image forming operation based on the image data for the warning display, also when determining to interrupt the image forming operation based on the image data, the determination unit continues the image forming operation based on the image data for the warning display when the operation reception unit receives a user instruction to continue the image forming operation based on the image data.

According to one or more embodiments, when a plurality of pages of the image data are included in a print job, the image data analysis unit sequentially analyzes the image data per page, and even when there is a page for which the image forming operation based on the image data is determined to interrupt in the pages, the determination unit determines to continue the image forming operation based on all the image data included in the subsequent pages to the page determined to interrupt when the operation reception unit receives a user instruction to continue the image forming operation based on the image data.

According to one or more embodiments, when a plurality of pages of the image data are included in a print job, the image data analysis unit sequentially analyzes the image data per page, and when there is a page for which the image forming operation based on the image data is determined to interrupt in the pages, the determination unit determines not to continue the image forming operation based on all the image data included in the subsequent pages to the page determined to interrupt.

According to one or more embodiments, an image forming method performed in an image forming system comprising an image forming unit capable of forming a normal image or an image to be foil-pressed on a recording material by use of at least one of a plurality of toners on the basis of image data, and a foil pressing unit configured to transfer foil onto the image to be foil-pressed comprises: an operation reception step of receiving an operation of selecting a foil pressing mode of causing the image forming unit to form the image to be foil-pressed or a normal mode of causing the image forming unit to form the normal image; an image data analysis step of analyzing the image data and acquiring the amount of each toner used for forming an image based on the image data; and a determination step of determining whether to interrupt the image forming operation based on the image data on the basis of the amount of each used toner acquired in the image data analysis step, wherein when the amount of toner not used for the image to be foil-pressed is a predetermined first threshold or more on the basis of the amount of each used toner acquired in the image data analysis step in the foil pressing mode, the image forming operation based on the image data is determined to interrupt in the determination step.

According to one or more embodiments, when the amount of toner used for the image to be foil-pressed is a predetermined second threshold or less on the basis of the amount of each used toner acquired in the image data analysis step in the foil pressing mode, the image forming operation based on the image data is determined to interrupt in the determination step.

According to one or more embodiments, when the amount of toner used for the image to be foil-pressed is a predetermined third threshold or more on the basis of the amount of each used toner acquired in the image data analysis step in the normal mode, the image forming operation based on the image data is determined to interrupt in the determination step.

According to one or more embodiments, when the amount of toner not used for the image to be foil-pressed is a predetermined fourth threshold or less on the basis of the amount of each used toner acquired in the image data analysis step in the normal mode, the image forming operation based on the image data is determined to interrupt in the determination step.

According to one or more embodiments, a non-transitory recording medium store a computer readable program executed by a computer in an image forming apparatus used in an image forming system comprising an image forming unit capable of forming a normal image or an image to be foil-pressed on a recording material by use of at least one of a plurality of toners on the basis of image data, and a foil pressing unit configured to transfer foil onto the image to be foil-pressed, and causes the computer to perform: an operation reception step of receiving an operation of selecting a foil pressing mode of causing the image forming unit to form the image to be foil-pressed or a normal mode of causing the image forming unit to form the normal image; an image data analysis step of analyzing the image data and acquiring the amount of each toner used for forming an image based on the image data; and a determination step of determining whether to interrupt the image forming operation based on the image data on the basis of the amount of each used toner acquired in the image data analysis step, wherein when the amount of toner not used for the image to be foil-pressed is a predetermined first threshold or more on the basis of the amount of each used toner acquired in the image data analysis step in the foil pressing mode, the image forming operation based on the image data is determined to interrupt in the determination step.

According to one or more embodiments, when the amount of toner used for the image to be foil-pressed is a predetermined second threshold or less on the basis of the amount of each used toner acquired in the image data analysis step in the foil pressing mode, the image forming operation based on the image data is determined to interrupt in the determination step.

According to one or more embodiments, when the amount of toner used for the image to be foil-pressed is a predetermined third threshold or more on the basis of the amount of each used toner acquired in the image data analysis step in the normal mode, the image forming operation based on the image data is determined to interrupt in the determination step.

According to one or more embodiments, when the amount of toner not used for the image to be foil-pressed is a predetermined fourth threshold or less on the basis of the amount of each used toner acquired in the image data analysis step in the normal mode, the image forming operation based on the image data is determined to interrupt in the determination step.

BRIEF DESCRIPTION OF THE DRAWINGS

The above and other advantages and features of one or more embodiments of the present invention will become more fully understood from the detailed description given hereinbelow and the appended drawings which are given by way of illustration only, and thus are not intended as a definition of the limits of the present invention, and wherein:

FIG. 8 is a flowchart illustrating a procedure of processing performed in an image forming system according to a variant.

DESCRIPTION OF THE EMBODIMENTS

Figure 1:
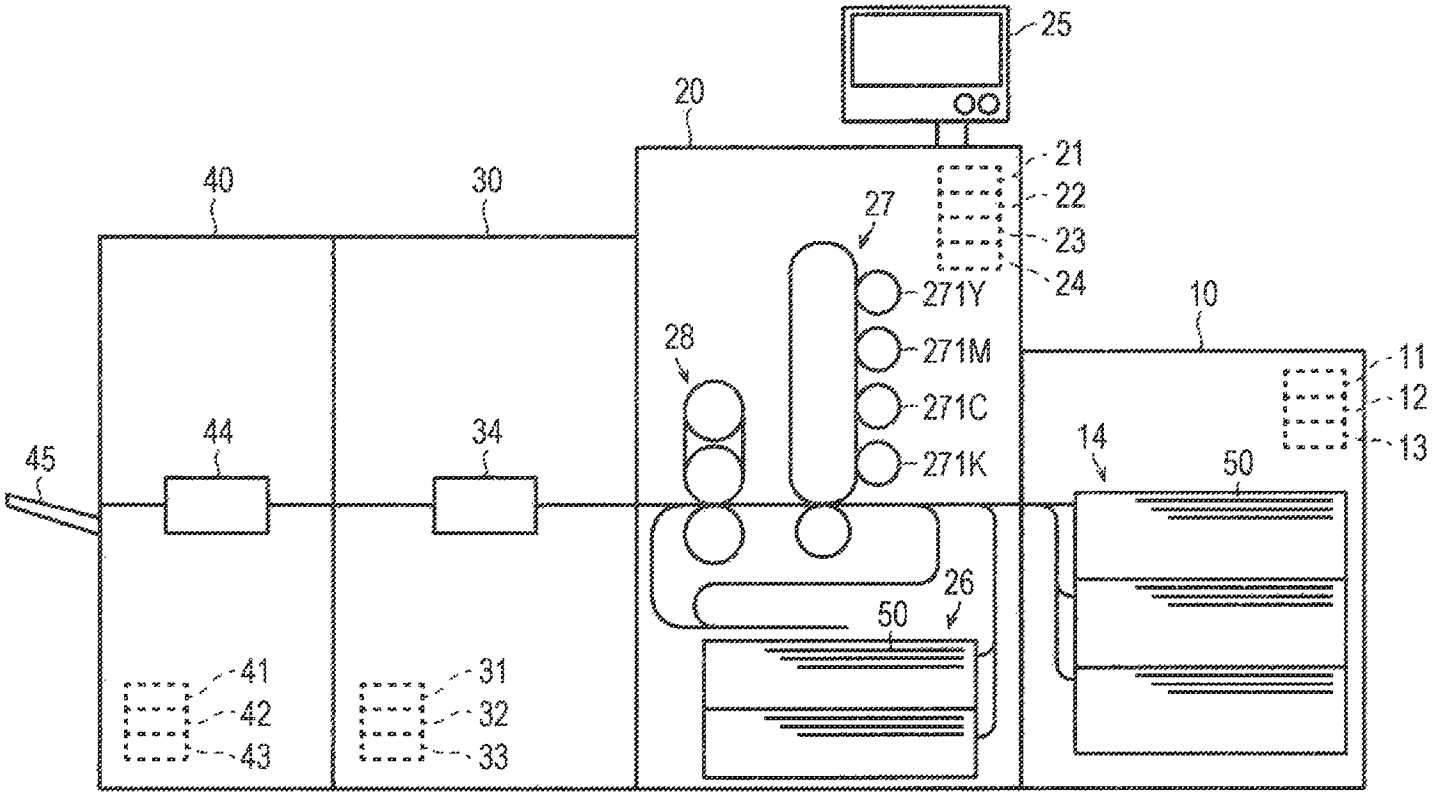
FIG. 1 is a diagram illustrating a schematic configuration of an image forming system according to one or more embodiments of the present invention.

Hereinafter, embodiments of the present invention will be described with reference to the drawings. However, the scope of the disclosure is not limited to the illustrated examples. The same components are denoted with the same reference numerals in the description of the drawings, and the repeated description will be omitted. Dimensional ratios in the drawings are exaggerated for convenience of the description and may be different from actual ratios.

Figure 2:
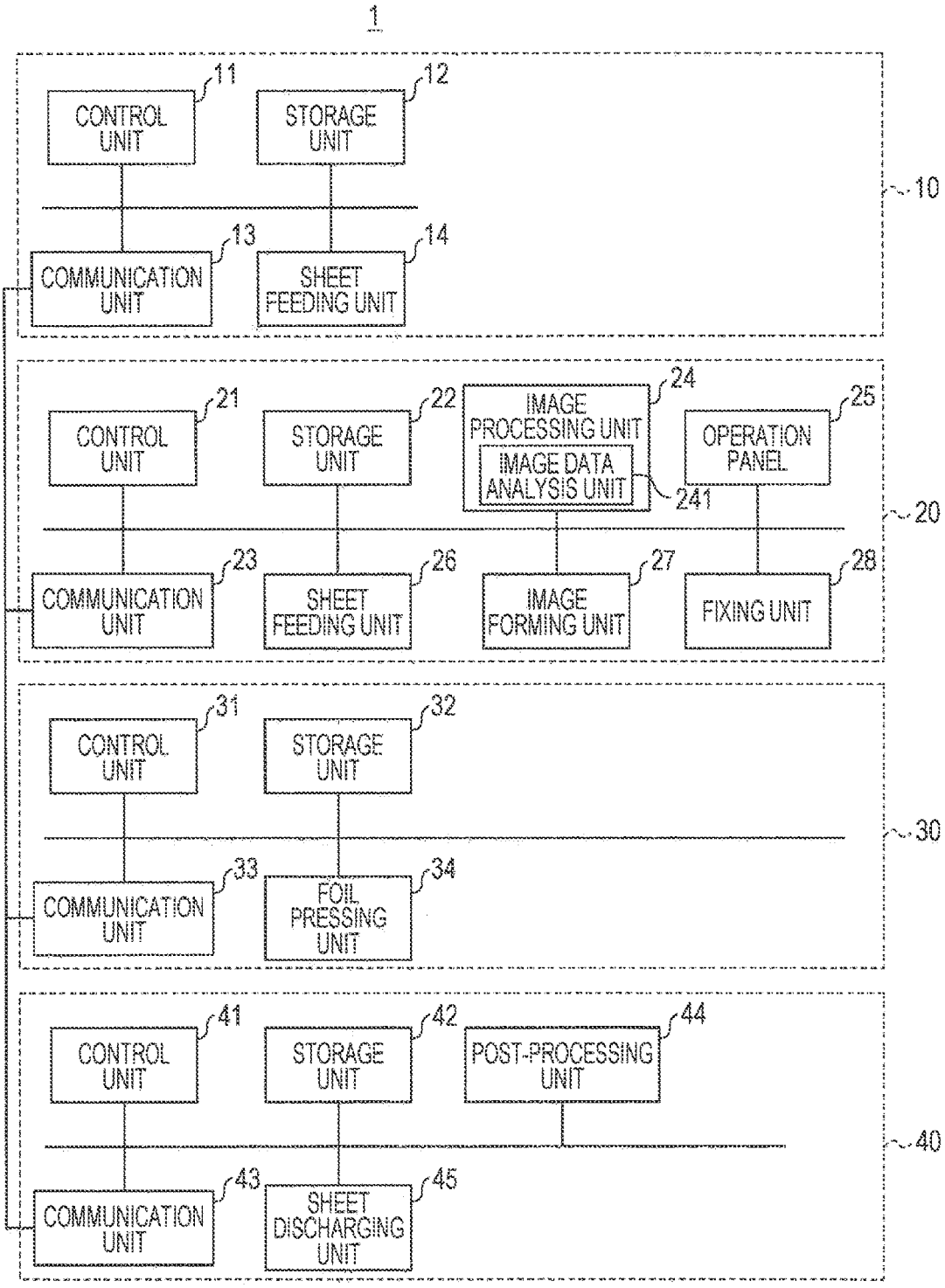
FIG. 2 is a block diagram illustrating a schematic configuration of a sheet feeding apparatus, an image forming apparatus, a foil pressing apparatus, and a post-processing apparatus.

FIG. 1 is a diagram illustrating a schematic configuration of an image forming system according to one or more embodiments of the present invention. FIG. 2 is a block diagram illustrating a schematic configuration of a sheet feeding apparatus, an image forming apparatus, a foil pressing apparatus, and a post-processing apparatus.

As illustrated in FIG. 1 and FIG. 2, an image forming system 1 includes a sheet feeding apparatus 10, an image forming apparatus 20, a foil pressing apparatus 30, and a post-processing apparatus 40. The sheet feeding apparatus 10, the image forming apparatus 20, the foil pressing apparatus 30 and the post-processing apparatus 40 are sequentially coupled from the upstream toward the downstream for sheet feeding. The image forming apparatus 20, the sheet feeding apparatus 10, the foil pressing apparatus 30, and the post-processing apparatus 40 will be described below in this order.

At first, the image forming apparatus 20 includes a control unit 21, a storage unit 22, a communication unit 23, an image processing unit 24, an operation panel 25, a sheet feeding unit 26, an image forming unit 27, and a fixing unit 28. The components are mutually connected via a bus for exchanging signals. The image forming apparatus 20 forms an image on a sheet as recording material on the basis of image data by use of an electrophotographic image forming process.

The image forming apparatus 20 is also called tandem-type color image forming apparatus, and forms a color image on a sheet in which images formed by toners in four sets of image forming units (image forming units) are overlapped. The image forming apparatus 20 forms an image to be foil-pressed on a sheet by predetermined toners used as adhesive when foil pressing is performed in the foil pressing apparatus 30 connected on the downstream. The image forming apparatus 20 forms an image to be foil-pressed by use of at least one of a plurality of color toners or by use of a dedicated toner (also called "glue toner" below) used as adhesive. A toner used for forming an image to be foil-pressed may be previously designated in the initial setting in the image forming apparatus 20 or may be arbitrarily changeable by the user.

The control unit 21 is a central processing unit (CPU), and controls each unit or performs various calculation processing according to the programs. A functional configuration of the control unit 21 will be described below.

The storage unit 22 is configured of a read only memory (ROM) for previously storing therein various programs or various items of data, a Random Access Memory (RAM) for temporarily storing programs or data as working area, a hard disc for storing therein various programs or various items of data, and the like.

The communication unit 23 is an interface for making communication with other devices, and exchanges setting values or various signals required for operation timing control with the sheet feeding apparatus 10, the foil pressing apparatus 30, and the post-processing apparatus 40. Further, the communication unit 23 can receive a print job including image data from a user's personal computer (PC) via a network.

The image processing unit 24 performs various image processing on the image data included in the print job as needed. For example, the image processing unit 24 performs a rasterization processing or the like on the image data included in the print job received from a user's PC or the like, thereby generating image data in a bitmap format. According to the present embodiment, the image processing unit 24 includes an image data analysis unit 241. The image data analysis unit 241 can analyze image data, and can acquire the amount of toner used for forming an image based on the image data per toner.

The operation panel 25 includes a touch panel, a numeric keypad, a start button, a stop button, and the like, and is used for displaying various items of information and inputting various instructions.

The sheet feeding unit 26 houses sheets 50 as recording material used for printing. The sheet feeding unit 26 has a plurality of sheet feeding trays, and feeds the sheets 50 housed in the sheet feeding trays to the image forming unit 27 one by one.

The image forming unit 27 forms an image based on various items of data on a transfer belt by use of a well-known image forming process such as an electrophotographic process including the steps of charging, exposure, development, transfer, and fixing, and transfers the image formed on the transfer belt onto the sheet 50. According to the present embodiment, the image forming unit 27 can form a normal image or an image to be foil-pressed on the sheet 50 by use of at least one of the toners on the basis of the image data.

The image forming unit 27 has an image forming unit 271Y for forming an yellow (Y) image, an image forming unit 271M for forming a magenta (M) image, an image forming unit 271C for forming a cyan (C) image, and an image forming unit 271K for forming a black (K) image. The image forming units 271Y, 271M, 271C, and 271K each have a photosensitive drum as image carrier as well as a charging unit, an optical write unit, a development device and a photosensitive drum cleaning device (which are not illustrated) which are arranged around the photosensitive drum. Each photosensitive drum rotates by a drum motor at a predetermined speed. Each development device houses a developer including each toner of yellow, magenta, cyan, or black.

In the image forming units 271Y, 271M, 271C, and 271K, at first, the optical write unit writes an image information signal based on image data of each color into the photosensitive drum, and a latent image based on the image information signal is formed on the photosensitive drum. Then, the development device develops the latent image so that a toner image as visible image is formed on the photosensitive drum. In this way, the image forming units 271Y, 271M, 271C, and 271K form an image of each toner of yellow, magenta, cyan, and black on the photosensitive drums, respectively.

According to the present embodiment, the image forming unit 27 may further have a dedicated image forming unit (not illustrated and also called "foil-dedicated image forming unit" below) for forming an image to be foil-pressed. The foil-dedicated image forming unit has a similar configuration as the image forming unit 271Y and the like, and houses a developer including glue toner therein. The foil-dedicated image forming unit forms an image on the photosensitive drum on the basis of the image data to be foil-pressed. When forming an image to be foil-pressed, the image forming unit 27 forms an image to be foil-pressed by use of at least one of the image forming units 271Y, 271M, 271C, and 271K or by use of the foil-dedicated image forming unit.

The fixing unit 28 thermally fixes the image formed on the sheet 50 by the image forming unit 27. The fixing unit 28 has a pressurization roller and a heating roller, and pressurizes and heats the sheet 50 on which the image is transferred thereby to fix the image on the sheet 50. The sheet 50 onto which the image is fixed by the fixing unit 28 is fed to the foil pressing apparatus 30.

Subsequently, the sheet feeding apparatus 10 includes a control unit 11, a storage unit 12, a communication unit 13, and a sheet feeding unit 14. The components are mutually connected via a bus for exchanging signals. The control unit 11, the storage unit 12, and the communication unit 13 have the similar functions to the control unit 21, the storage unit 22, and the communication unit 23 in the image forming apparatus 20, respectively, and thus the description thereof will be omitted.

Herein, the sheet feeding unit 14 has a plurality of sheet feeding trays, and feeds the sheet 50 housed in the sheet feeding trays to the image forming apparatus 20 one by one.

Subsequently, the foil pressing apparatus 30 includes a control unit 31, a storage unit 32, a communication unit 33, and a foil pressing unit 34. The components are mutually connected via a bus for exchanging signals. The control unit 31, the storage unit 32, and the communication unit 33 have the similar functions to the control unit 21, the storage unit 22, and the communication unit 23 in the image forming apparatus 20, respectively, and thus the description thereof will be omitted.

Herein, the foil pressing unit 34 transfers foil onto the sheet 50 thereby to form a foil image by use of a toner image to be foil-pressed formed on the sheet 50 as adhesive. For example, the foil pressing unit 34 feeds a foil film sheet in which a foil film is formed on the surface of the base material, and superimposes it on the image to be foil-pressed on the sheet 50 to be heated and pressurized. Thereby, the foil is transferred onto the image to be foil-pressed on the sheet 50 thereby to form a foil image. The sheet 50 onto which the foil is transferred by the foil pressing unit 34 is fed to the post-processing apparatus 40.

Subsequently, the post-processing apparatus 40 includes a control unit 41, a storage unit 42, a communication unit 43, a post-processing unit 44, and a sheet discharging unit 45, and the components are mutually connected via a bus for exchanging signals. The control unit 41, the storage unit 42, and the communication unit 43 have the similar functions to the control unit 21, the storage unit 22, and the communication unit 23 in the image forming apparatus 20, respectively, and thus the description thereof will be omitted.

Herein, the post-processing unit 44 performs a post-processing such as stapling processing or punching processing on the sheet 50 fed from the foil pressing apparatus 30.

The sheet discharging unit 45 discharges the sheet 50 passing through the post-processing unit 44 to the outside of the post-processing apparatus 40.

The sheet feeding apparatus 10, the image forming apparatus 20, the foil pressing apparatus 30, and the post-processing apparatus 40 may include any component other than the above components, or may not include any of the above components.

As described above, the image forming system 1 according to the present embodiment transfers foil onto an image to be foil-pressed formed by toners, thereby performing foil pressing print. A flow of the processing of performing foil pressing print in the image forming system 1 will be described below.

At first, the image forming apparatus 20 receives a print job including image data to be foil-pressed while a mode of forming an image to be foil-pressed and performing foil pressing print (which will be called "foil pressing mode" below) is being set. The image forming apparatus 20 then forms an image to be foil-pressed on the sheet 50 fed from the sheet feeding unit 26 or the sheet feeding unit 14 in the sheet feeding apparatus 10. The foil pressing apparatus 30 then transfers foil onto the sheet 50 on which the image to be foil-pressed is formed, thereby forming a foil image. Finally, the post-processing apparatus 40 discharges the sheet 50 forming the foil image thereon to the sheet discharging unit 45.

When both a foil image and a normal image are formed on a sheet, the sheet 50 discharged to the sheet discharging unit 45 needs to be set in the sheet feeding unit 26 or the sheet feeding unit 14 again after the foil image is formed. The image forming apparatus 20 receives a print job including normal image data while a mode of forming not an image to be foil-pressed but a normal image and performing normal print (which will be called "normal mode" below) is being set. The image forming apparatus 20 then forms the normal image on the reset sheet 50. In the normal mode, the foil pressing apparatus 30 does not form a foil image and passes the sheet 50 forming the normal image thereon. Finally, the post-processing apparatus 40 discharges the sheet 50 passing through the foil pressing apparatus 30 to the sheet discharging unit 45. Thereby, the image forming system 1 can output a printed material on which both the foil image and the normal image are formed.

A functional configuration of the control unit 21 in the image forming apparatus 20 will be described below.

Figure 3:
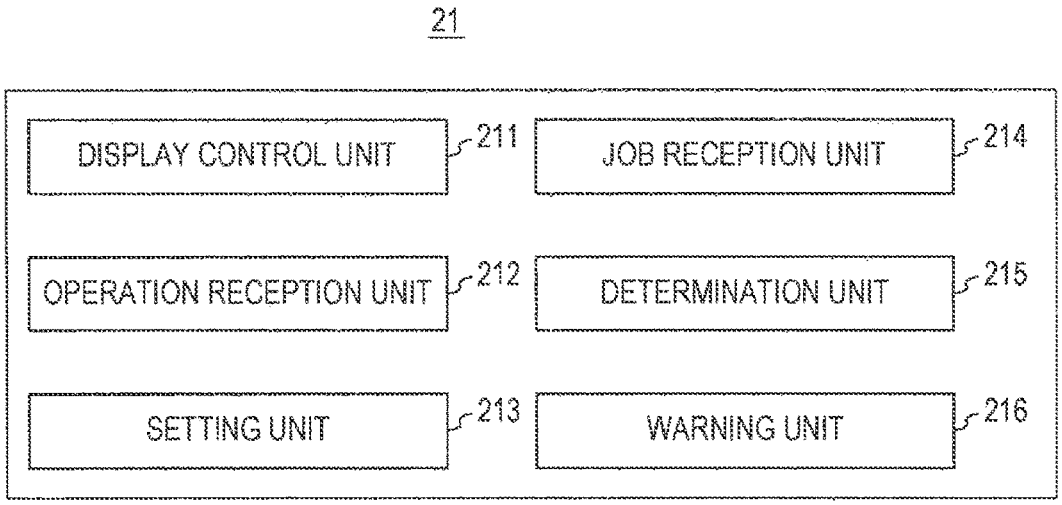
FIG. 3 is a block diagram illustrating a functional configuration of a control unit in the image forming apparatus.

FIG. 3 is a block diagram illustrating a functional configuration of the control unit in the image forming apparatus.

According to the present embodiment, the control unit 21 in the image forming apparatus 20 reads the programs to perform the processing thereby to function as a display control unit 211, an operation reception unit 212, a setting unit 213, a job reception unit 214, a determination unit 215, and a warning unit 216.

The display control unit 211 controls a screen displayed on the operation panel 25 and the like. The display control unit 211 can cause a user-operable operation screen to be displayed on the operation panel 25, for example.

The operation reception unit 212 receives user operations via the operation panel 25 and the like. The operation reception unit 212 can receive a user operation of selecting the foil pressing mode or the normal mode, for example.

The setting unit 213 performs or changes various settings of the image forming apparatus 20 in response to a user operation.

The job reception unit 214 receives a print job from the user. The print job can designate therein full-color print, single-color print, monochrome print, or the like.

The determination unit 215 determines whether to interrupt the image forming operation as needed. Herein, "to interrupt the image forming operation" means to interrupt the operation in the image forming system 1, and means not causing the image forming apparatus 20 including the image forming unit 27, the foil pressing apparatus 30, the post-processing apparatus 40, and the like to perform each processing. The determination unit 215 determines whether to interrupt forming an image on the basis of the image data in the image forming unit 27 or forming a foil image in the foil pressing apparatus 30 on the basis of the amount of each used toner acquired by the image data analysis unit 241.

The warning unit 216 gives a warning including warning display to the user as needed.

The processing in the image forming system 1 will be described below.

Figure 4:
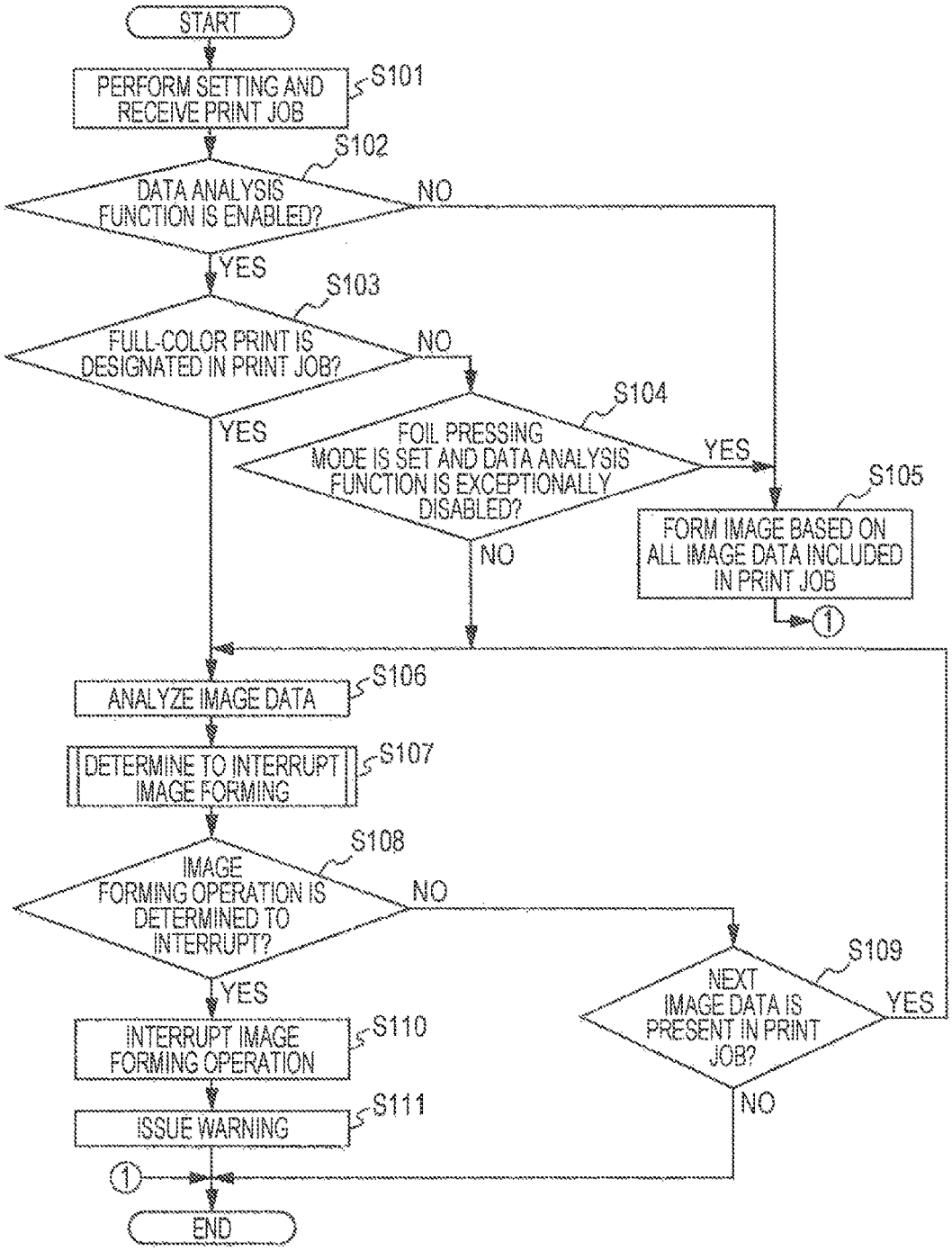
FIG. 4 is a flowchart illustrating a procedure of processing performed in the image forming system.
Figure 5:
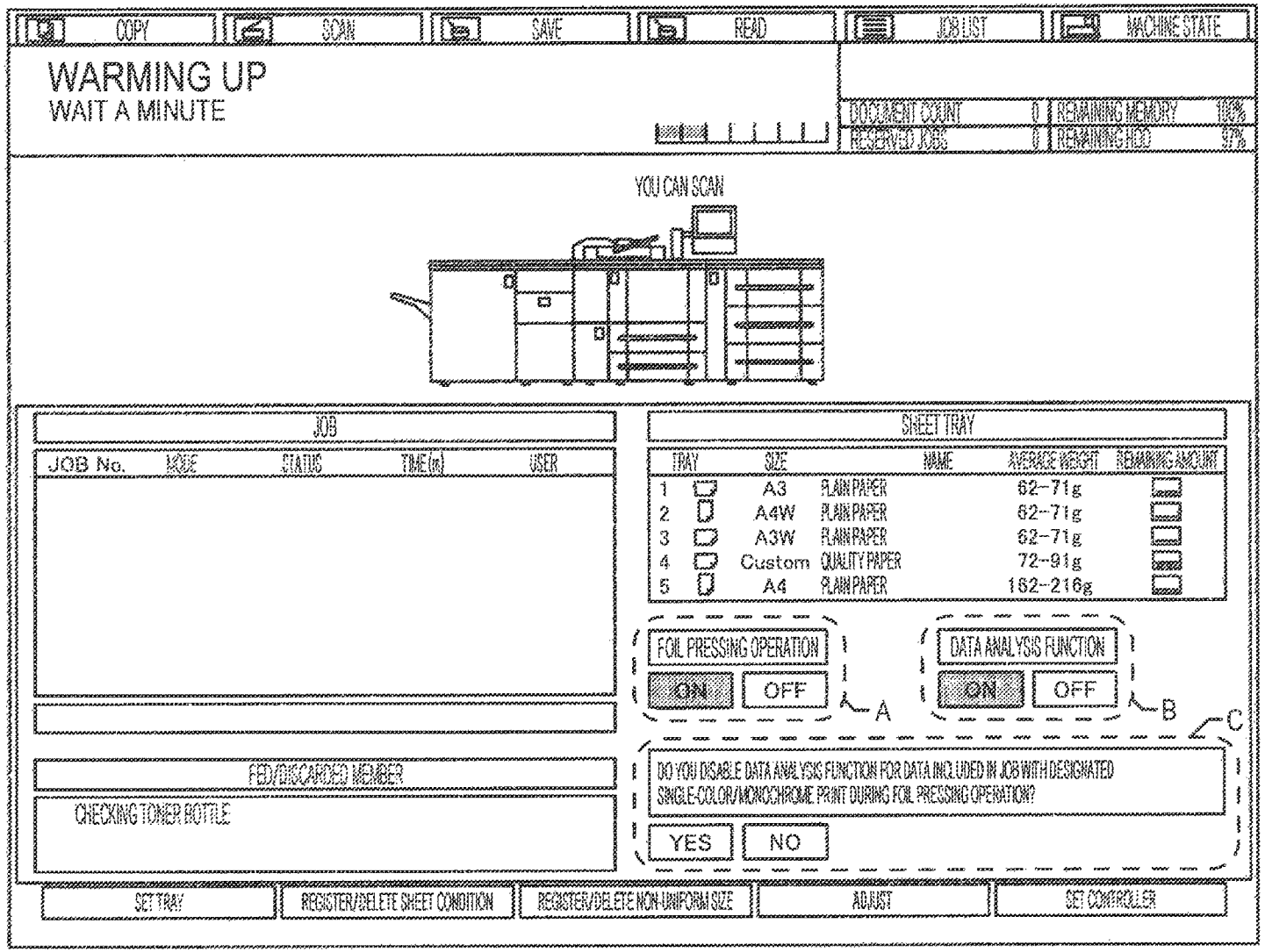
FIG. 5 is a diagram illustrating an exemplary operation screen displayed on an operation panel in the processing in step S101 in FIG. 4.

FIG. 4 is a flowchart illustrating a procedure of the processing performed in the image forming system. FIG. 5 is a diagram illustrating an exemplary operation screen displayed on the operation panel in the processing in step S101 in FIG. 4. An algorithm illustrated in the flowchart of FIG. 4 is stored as a program in the storage unit 22 in the image forming apparatus 20, and is executed by the control unit 21.

As illustrated in FIG. 4, the image forming apparatus 20 first performs various settings in response to user's operations, and receives a print job (step S101). Specifically, the control unit 21 in the image forming apparatus 20 as the display control unit 211 displays an operation screen as illustrated in FIG. 5 on the operation panel 25. The control unit 21 then receives a user operation in the operation panel 25 as the operation reception unit 212, and sets the image forming apparatus 20 on the basis of the received user operations as the setting unit 213. Further, the control unit 21 as the job reception unit 214 receives a print job from the user.

On the operation screen illustrated in FIG. 5, "foil pressing operation," "data analysis function," or "whether to exceptionally disable the data analysis function during foil pressing operation" is selected.

The control unit 21 receives a user operation of selecting "whether to perform the foil pressing operation (foil pressing print)" in the operation unit A surrounded in a broken line. When functioning as the operation reception unit 212 and receiving the operation of selecting the "ON" button, the control unit 21 as the setting unit 213 sets the print mode at the foil pressing mode. On the other hand, when receiving the operation of selecting the "OFF" button, the control unit 21 sets the normal mode.

The control unit 21 receives the user operation of selecting "whether to enable the data analysis function" in the operation unit B surrounded in a broken line. The "data analysis function" is to cause the image data analysis unit 241 to analyze image data and to acquire the amount of each used toner in the image based on the image data. When functioning as the operation reception unit 212 and receiving the operation of selecting the "ON" button, the control unit 21 as the setting unit 213 enables the data analysis function (causes the image data analysis unit 241 to analyze image data). On the other hand, when receiving the operation of selecting the "OFF" button, the control unit 21 disables the data analysis unit (does not cause the image data analysis unit 241 to analyze image data).

The control unit 21 receives the user operation of selecting "whether to exceptionally disable the data analysis function during the foil pressing operation (in the foil pressing mode)" in the operation unit C surrounded in a broken line. In the example illustrated in FIG. 5, the control unit 21 receives the user operation of selecting "whether to disable the data analysis function for the data included in the print job designating single-color print or monochrome print therein during the foil pressing operation (in the foil pressing mode)." When functioning as the operation reception unit 212 and receiving the operation of selecting the "YES" button, the control unit 21 as the setting unit 213 disables the data analysis function for the image data for which single-color print or monochrome print is designated during the foil pressing operation. On the other hand, when receiving the operation of selecting the "NO" button, the control unit 21 does not disable the data analysis function for the image data for which single-color print or monochrome print is designated during the foil pressing operation. The operation unit C functions assuming that the foil pressing mode is set in the operation unit A, and thus may be selectable only when the operation of selecting the "ON" button is received in the operation unit A. Alternatively, the operation unit C may be displayed on the operation panel 25 only when the operation of selecting the "ON" button is received in the operation unit A.

After setting and receiving the print job in step S101, the control unit 21 confirms whether the data analysis function is enabled in step S101 (step S102).

When not enabling the data analysis function (step S102: NO) or disabling the data analysis function, the control unit 21 proceeds to the processing in step S105. The processing in step S105 will be described below.

When enabling the data analysis function (step S102: YES), the control unit 21 confirms whether full-color print is designated in the print job received in step S101 (step S103). In the example according to the present embodiment, any of full-color print, single-color print and monochrome print is designated in a print job.

When full-color print is designated in the print job (step S103: YES), the control unit 21 proceeds to the processing in step S106. The processing in step S106 will be described below.

When full-color print is not designated in the print job (step S103: NO) or single-color print or monochrome print is designated in the print job, the control unit 21 proceeds to step S104.

Subsequently, the control unit 21 confirms whether it sets the print mode at the foil pressing mode and it exceptionally disables the data analysis function during the foil pressing operation in step S101 (step S104). That is, in the example according to the present embodiment, the control unit 21 confirms whether it sets the foil pressing mode and sets "to disable the data analysis function for the data included in the print job designating single-color print or monochrome print therein during the foil pressing operation."

When setting the foil pressing mode and exceptionally disabling the data analysis function (step S104: YES), the control unit 21 proceeds to the processing in step S105.

In the case of NO in step S102 or YES in step S104, the control unit 21 causes the image forming system 1 to form an image based on the image data included in the print job (step S105). That is, the image forming system 1 causes the image forming apparatus 20 including the image forming unit 27, the foil pressing apparatus 30, the post-processing apparatus 40, and the like to perform each processing thereby to form an image. The control unit 21 then terminates the processing.

The processing in step S105 is performed when the data analysis function is disabled (step S102: NO) or when the foil pressing mode is set and the data analysis function is exceptionally disabled (step S104: YES). In this case, the image forming apparatus 20 performs the basic processing as image forming apparatus, or forms an image based on the image data included in the print job.

On the other hand, when the foil pressing mode is set and the data analysis function is not exceptionally disabled (step S104: NO), the control unit 21 proceeds to the processing in step S106. Thus, when setting the print mode at the normal mode, the control unit 21 always proceeds to step S106.

In the case of YES in step S103 or NO in step S104, the control unit 21 causes the image data analysis unit 241 to analyze the image data included in the print job received in step S101 (step S106). The control unit 21 may cause the image data analysis unit 241 to analyze the image data before causing the image forming unit 27 to form an image, or may cause the image data analysis unit 241 to analyze the image data while or after causing the image forming unit 27 to form an image. The control unit 21 causes the image data analysis unit 241 to analyze the image data before feeding a sheet to the apparatus on the downstream in sheet feeding (the foil pressing apparatus 30 according to the present embodiment) at the latest.

In the processing in step S106, the image data analysis unit 241 analyzes one page of image data per processing, and acquires the amount of toner used for forming an image based on the image data per toner. The image data analysis unit 241 acquires the amount of each used toner on the basis of the amount of data of each of yellow, magenta, cyan and black included in the image data. When a glue toner is used for forming an image, the image data analysis unit 241 analyzes the image data and acquires the amount of used glue toner.

Subsequently, the control unit 21 as the determination unit 215 proceeds to an image forming interruption determination processing of determining whether to interrupt the image forming operation on the basis of the amount of each used toner acquired by the image data analysis unit 241 (step S107). The image forming interruption determination processing will be described below in detail.

Subsequently, the control unit 21 confirms whether it determines to interrupt the image forming operation in the image forming interruption determination processing in step S107 (step S108).

When determining not to interrupt the image forming operation (step S108: NO), the control unit 21 confirms whether next image data is present in the print job (step S109). That is, when a plurality of pages of image data are included in the print job, the control unit 21 confirms whether a subsequent page remains in the print job.

When next image data is present (step S109: YES), the control unit 21 returns to the processing in step S106, and repeatedly performs the processing in and subsequent to step S106. That is, when a plurality of pages of image data are included in the print job, the control unit 21 returns to the processing in step S106 in order to analyze the image data in a next page.

When next image data is not present (step S109: NO), the control unit 21 terminates the processing.

On the other hand, in step S108, when determining to interrupt the image forming operation (step S108: YES), the control unit 21 interrupts the image forming operation on the basis of the image data analyzed by the image data analysis unit 241 (step S110). The control unit 21 as the warning unit 216 then gives a warning including warning display to the user (step S111). Thereafter, the control unit 21 terminates the processing.

Interruption of the image forming operation will be more specifically described below. At first, it is assumed that the control unit 21 causes the image data analysis unit 241 to analyze image data while or after causing the image forming unit 27 to form an image in the foil pressing mode. In this case, when determining to interrupt the image forming operation, the control unit 21 does not feed the sheet 50 on which an image is formed by the image forming unit 27 to the foil pressing apparatus 30. Alternatively, the control unit 21 controls the foil pressing unit 34 not to transfer foil via the control unit 31 in the foil pressing apparatus 30. Thus, the image forming operation in the image forming system 1 is not completed. When determining to interrupt the image forming operation, the image forming system 1 discharges the sheet 50 forming an image thereon to a different sheet discharging unit (not illustrated) from the normal sheet discharging unit 45, and then interrupts the operation.

It is assumed that the control unit 21 causes the image data analysis unit 241 to analyze image data while or after causing the image forming unit 27 to form an image in the normal mode. In this case, when determining to interrupt the image forming operation, the control unit 21 does not feed the sheet 50 on which an image is formed by the image forming unit 27 to the post-processing apparatus 40. Alternatively, the control unit 21 controls the post-processing unit 44 not to perform a post-processing via the control unit 41 in the post-processing apparatus 40. Thus, the image forming operation in the image forming system 1 is not completed. When determining to interrupt the image forming operation, the image forming system 1 discharges the sheet 50 forming an image thereon to a different sheet discharging unit (not illustrated) from the normal sheet discharging unit 45, and then interrupts the operation.

Warning display in step S111 will be described more specifically below.

Figure 6:
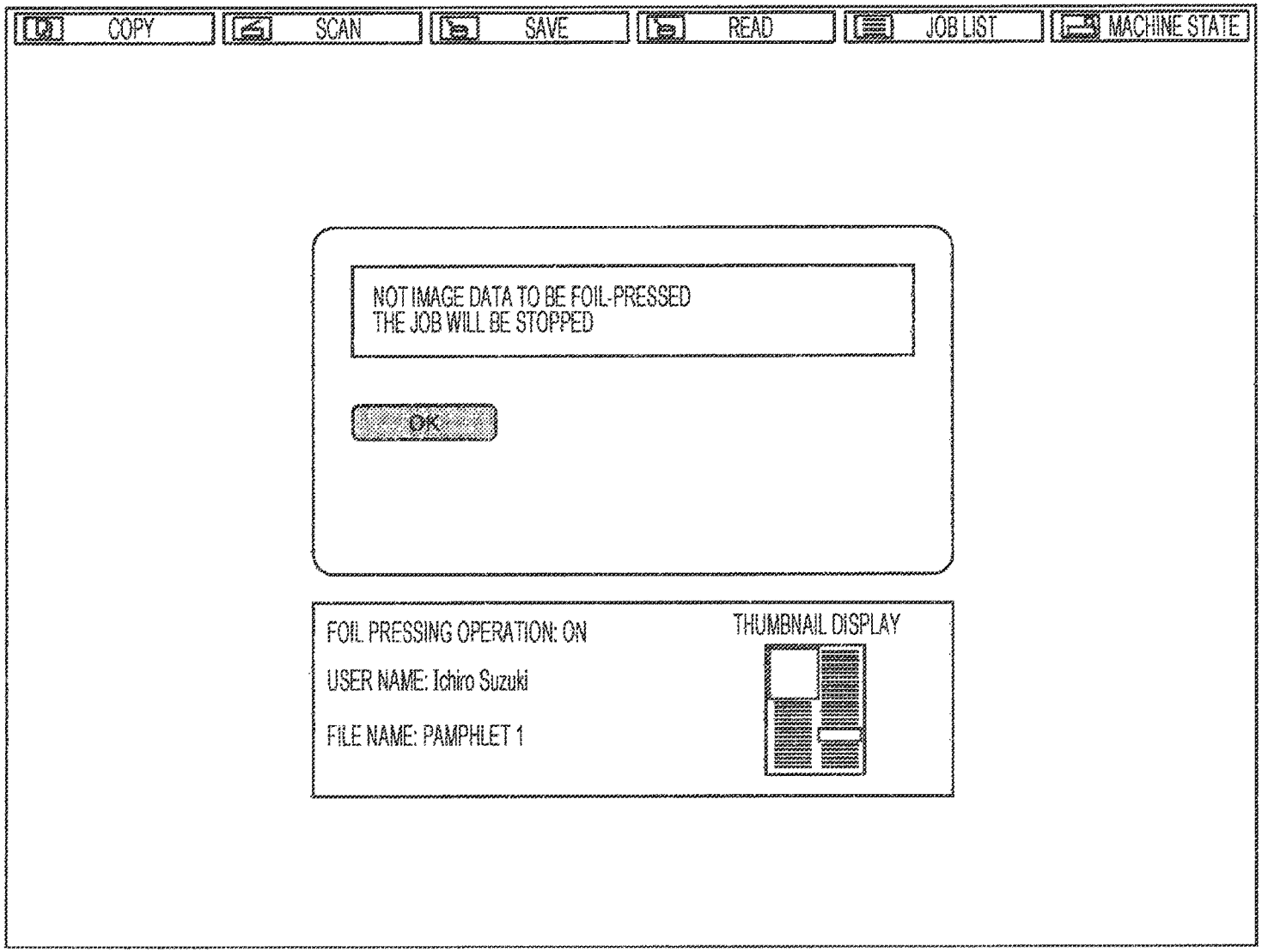
FIG. 6 is a diagram illustrating exemplary warning display displayed on the operation panel in the processing in step S111 in FIG. 4.

FIG. 6 is a diagram illustrating exemplary warning display displayed on the operation panel in the processing in step S111 in FIG. 4.

As illustrated in FIG. 6, the control unit 21 as the warning unit 216 displays warning display for the user on the operation panel 25 or the like via the display control unit 211. The control unit 21 may display similar display on the user's PC or the like. The control unit 21 may perform a different processing such as issuing a warning sound together with performing warning display or instead of warning display.

The warning display includes a message indicating the contents of a warning as illustrated in FIG. 6. The warning display may include display as to whether the foil pressing mode is set. Further, the warning display may further include a file name including image data, thumbnail display of image data, display of transmitter's user name, or the like.

In step S111, the control unit 21 may wait for the user to confirm the contents of the message included in the warning display (to press the "OK" button illustrated in FIG. 6). Alternatively, the control unit 21 may be configured such that a standby time is restricted and when the predetermined time exceeds, the processing is automatically terminated.

The image forming interruption determination processing in step S107 will be described below in detail.

Figure 7:
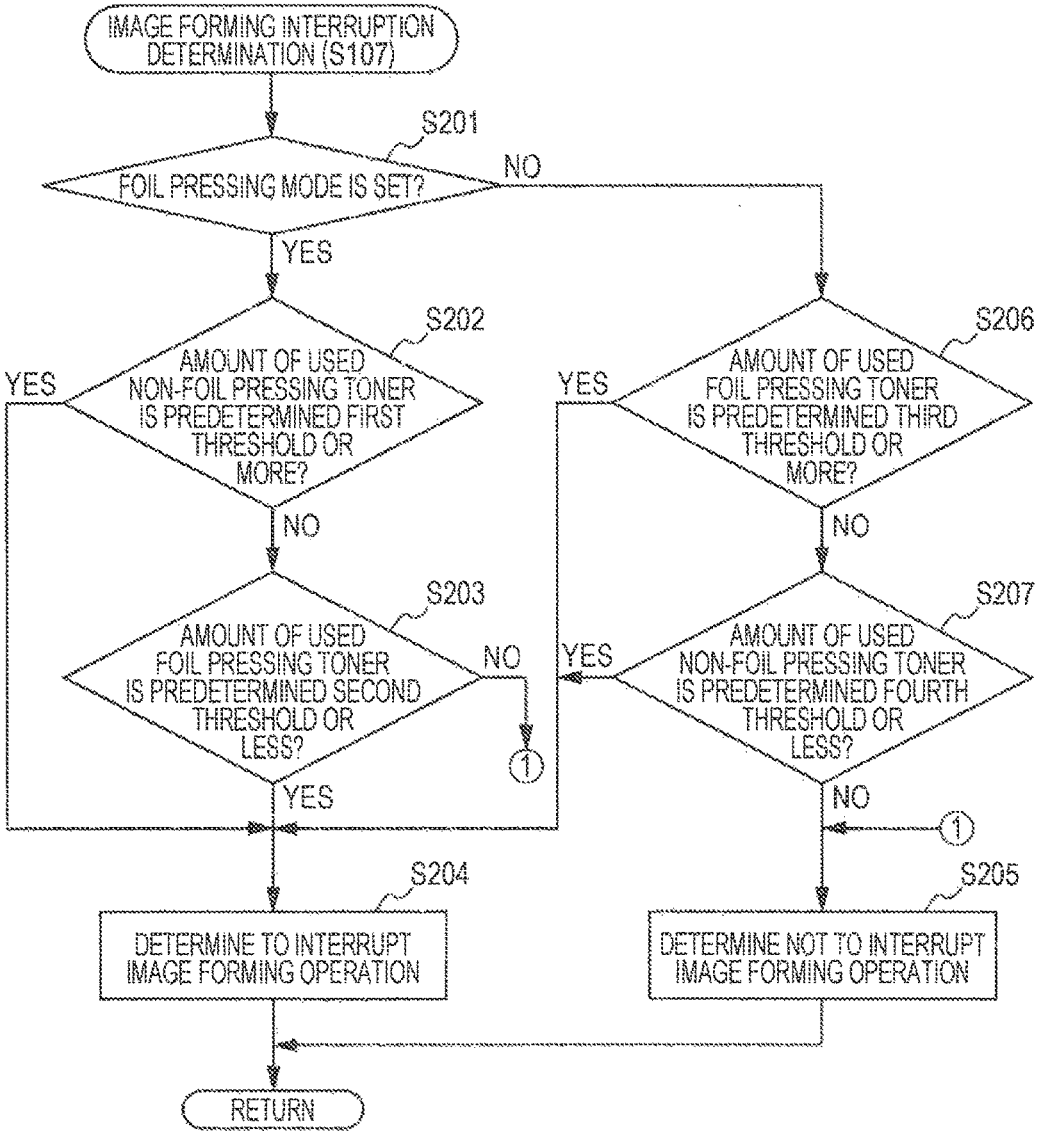
FIG. 7 is a sub-routine flowchart illustrating a procedure of the image forming interruption determination processing in step S107 in FIG. 4.

FIG. 7 is a sub-routine flowchart illustrating a procedure of the image forming interruption determination processing in step S107 in FIG. 4.

As illustrated in FIG. 7, the control unit 21 first confirms whether the print mode is set at the foil pressing mode in step S101 (step S201).

When the foil pressing mode is set (step S201: YES), the control unit 21 as the determination unit 215 determines whether the amount of toner not used for forming an image to be foil-pressed is a predetermined first threshold or more (step S202). A toner not used for forming an image to be foil-pressed will be called "non-foil pressing toner" below. The control unit 21 makes the above determination on the basis of the amount of each used toner acquired by the image data analysis unit 241 in step S106.

When the amount of used non-foil pressing toner is the predetermined first threshold or more (step S202: YES), the control unit 21 proceeds to the processing in step S204. The processing in step S204 will be described below in detail.

When the amount of used non-foil pressing toner is less than the predetermined first threshold (step S202: NO), the control unit 21 proceeds to the processing in step S203. The control unit 21 as the determination unit 215 then determines whether the amount of toner used for forming an image to be foil-pressed is a predetermined second threshold or less (step S203).

A toner used for forming an image to be foil-pressed will be called "foil pressing toner" below. A foil pressing toner may be previously designated by a user operation on the operation panel 25 or the like. One or more toners may be designated as foil pressing toners. For example, only a cyan toner may be designated, or cyan and yellow toners may be designated as foil pressing toners. According to the present embodiment, the user needs to confirm a toner used as foil pressing toner and to create image data to be foil-pressed by use of a color corresponding to the foil pressing toner before creating image data to be foil-pressed.

Further, the predetermined "first threshold" and "second threshold" may be set by a user operation on the operation panel 25 or the like, or may be previously set in the initial setting in the image forming apparatus 20. The first threshold may be set for each of the non-foil pressing toners, and the second threshold may be set for each of the foil pressing toners when two or more foil pressing toners are present.

When the amount of used foil pressing toner is the predetermined second threshold or less (step S203: YES), the control unit 21 proceeds to the processing in step S204.

In the case of YES in step S202 or YES in step S203, the control unit 21 as the determination unit 215 determines to interrupt the image forming operation on the basis of the image data analyzed by the image data analysis unit 241 (step S204). The control unit 21 then returns to the processing in FIG. 4.

On the other hand, when the amount of used foil pressing toner is higher than the predetermined second threshold (step S203: NO), the control unit 21 as the determination unit 215 determines not to interrupt the image forming operation on the basis of the image data analyzed by the image data analysis unit 241 (step S205). The control unit 21 then returns to the processing in FIG. 4.

An image to be foil-pressed is formed by use of a foil pressing toner. On the other hand, a normal image can be formed by use of both a foil pressing toner and a toner other than the foil pressing toner. For example, a foil pressing toner is assumed as a cyan toner. In this case, image data to be foil-pressed needs to be created by use of a cyan color corresponding to the cyan toner. Herein, in step S202, when the amount of used toner other than cyan is the predetermined first threshold or more, the image data contains a certain amount of data of the color other than cyan. Thus, the control unit 21 determines that the image data is likely to be normal image data and the print mode (the foil pressing mode) is likely to mismatch with the image data. On the other hand, when the amount or more of used toner other than cyan is less than the predetermined first threshold, the control unit 21 determines that the image data is likely to be image data to be foil-pressed and the print mode is likely to match with the image data.

In step S203, when the amount of used cyan toner is the predetermined second threshold or less, cyan data is lacking in the image data. Thus, the control unit 21 determines that the image data is likely not to be image data to be foil-pressed and the print mode (the foil pressing mode) is likely to mismatch with the image data. On the other hand, when the amount of used cyan toner is higher than the predetermined second threshold, the control unit 21 determines that the image data is likely to be image data to be foil-pressed including enough cyan data and the print mode is likely to match with the image data. When determining that the setting of the print mode matches with the image data in both steps S202 and S203, the control unit 21 determines not to interrupt the image forming operation.

Returning to step S201, when the print mode is not set at the foil pressing mode (step S201: NO) or the normal mode is set, the control unit 21 proceeds to the processing in step S206. The control unit 21 as the determination unit 215 then determines whether the amount of used foil pressing toner is predetermined third threshold or more (step S206). The control unit 21 makes the above determination on the basis of the amount of used toner acquired by the image data analysis unit 241 in step S106.

When the amount of used foil pressing toner is the predetermined third threshold or more (step S206: YES), the control unit 21 proceeds to the processing in step S204. Thereafter, the control unit 21 returns to the processing in FIG. 4.

When the amount of used foil pressing toner is less than the predetermined third threshold (step S206: NO), the control unit 21 as the determination unit 215 determines whether the amount of used non-foil pressing toner is predetermined fourth threshold or less (step S207).

The predetermined "third threshold" and "fourth threshold" may be set by a user operation on the operation panel 25 or the like, or may be previously set in the initial setting in the image forming apparatus 20. When two or more foil pressing toners are present, the third threshold may be set for each of the foil pressing toners, and the fourth threshold may be set for each of the non-foil pressing toners.

When the amount of used non-foil pressing toner is the predetermined fourth threshold or less (step S207: YES), the control unit 21 proceeds to the processing in step S204. Thereafter, the control unit 21 returns to the processing in FIG. 4.

In the case of YES in step S206 or YES in step S207, the control unit 21 determines to interrupt the image forming operation on the basis of the image data analyzed by the image data analysis unit 241 in step S204.

On the other hand, when the amount of used non-foil pressing toner is higher than the predetermined fourth threshold (step S207: NO), the control unit 21 as the determination unit 215 determines not to interrupt the image forming operation on the basis of the image data analyzed by the image data analysis unit 241 (step S205). The control unit 21 then returns to the processing in FIG. 4.

For example, a foil pressing toner is assumed as a cyan toner. When the amount of used cyan toner is the predetermined third threshold or more in step S206, the image data includes excessive cyan data. Thus, the control unit 21 determines that the image data is likely to be image data to be foil-pressed and the print mode (the normal mode) is likely to mismatch with the image data. On the other hand, when the amount of used cyan toner is less than the predetermined third threshold, the control unit 21 determines that the image data is likely to be normal image data and the print mode is likely to match with the image data.

When the amount of used toner other than cyan is the predetermined fourth threshold or less in step S207, the data of the colors other than cyan is lacking in the image data. Thus, the control unit 21 determines that the image data is likely not to be normal image data and the print mode (the normal mode) is likely to mismatch with the image data. On the other hand, when the amount of used toner other than cyan is higher than the predetermined fourth threshold, the control unit 21 determines that the image data is likely to be normal image data including enough data of the colors other than cyan and the print mode is likely to match with the image data. When determining that the print mode matches with the image data in both steps S206 and S207, the control unit 21 determines not to interrupt the image forming operation.

As described above, with the image forming system 1 according to the present embodiment, when the amount of used non-foil pressing toner is the predetermined first threshold or more in the foil pressing mode, the image forming operation based on image data is interrupted. When forming an image based on image data in the foil pressing mode, the image forming system 1 can determine whether the image data is image data to be foil-pressed on the basis of the amount of used non-foil pressing toner. When the used amount of at least one non-foil pressing toner is the predetermined first threshold or more, the image forming system 1 then determines that the print mode mismatches with the image data, and does not transfer foil in the foil pressing apparatus 30. Consequently, the image forming system 1 can avoid a printed material from being output while user-unintended foil is pressed, thereby preventing useless printing such as waste of expensive foil.

The predetermined first threshold is set in the following viewpoints. When forming an image, the image forming system 1 may add a predetermined mark or the like included in a predetermined format to user's image data. For example, a small color chart for a plurality of colors may be formed at an end of a sheet or a mark indicating a cut position may be formed on a sheet in order to check the printed colors. In this case, the predetermined mark or the like may be formed by use of a plurality of toners, and thus a small amount of user-unintended non-foil pressing toner is used. Thus, the image forming system 1 can set the predetermined first threshold in order to prevent the use of a slight amount of toner from influencing the determination. Thus, the image forming system 1 can more accurately determine user's image data not depending on a use environment. Thereby, the predetermined first threshold may be set to correspond to the amount of non-foil pressing toner usable for forming a color chart, such as a coverage of 0.1%.

The predetermined first threshold can be set per non-foil pressing toner. For example, the amounts of toners used for forming a predetermined mark or the like are assumed to be different per toner. In this case, the used amount allowable for a non-foil pressing toner is different per toner. Thus, the image forming system 1 can set the first threshold per non-foil pressing toner, thereby enhancing an accuracy of the processing on image data.

When the amount of used foil pressing toner is the predetermined second threshold or less in the foil pressing mode, the image forming system 1 interrupts the image forming operation based on image data. When forming an image based on image data in the foil pressing mode, the image forming system 1 can determine whether the image data is image data to be foil-pressed on the basis of the amount of used foil pressing toner. At least one toner may be designated as the foil pressing toner, and thus the non-foil pressing toners are generally more than the foil pressing toners. Thus, the image forming system 1 can decrease the toners to be determined when making a determination on the basis of not the amount of used non-foil pressing toner but the amount of used foil pressing toner, thereby simplifying the processing. Consequently, the image forming system 1 can more efficiently make a determination.

The predetermined second threshold is set in the following viewpoints. The image forming system 1 can set the predetermined second threshold in order to confirm that the amount of used foil pressing toner is more than the amount of used foil pressing toner substantially usable for forming an image to be foil-pressed. On the basis of the assumption, the predetermined second threshold may be set as the amount of foil pressing toner substantially usable for forming an image to be foil-pressed, such as a value corresponding to a coverage of 0.5%, and may be changed depending on the contents of image data.

Further, when the amount of used foil pressing toner is the predetermined third threshold or more in the normal mode, the image forming system 1 interrupts the image forming operation based on image data. When forming an image based on image data in the normal mode, the image forming system 1 can determine whether the image data is normal image data on the basis of the amount of used foil pressing toner. The image forming system 1 can determine matching between the print mode and the image data on the basis of the amount of used foil pressing toner in not only the foil pressing mode but also the normal mode. When determining that the print mode mismatches with the image data, the image forming system 1 does not perform a post-processing in the post-processing apparatus 40. Consequently, the image forming system 1 does not need to perform a post-processing such as stapling processing or punching processing on a user-unintended printed material.

The predetermined third threshold is set in the following viewpoints. A foil pressing toner is used for forming an image to be foil-pressed and for a normal image. However, a non-foil pressing toner is also used for forming a normal image, and thus in many cases, the amount of foil pressing toner does not remarkably increase. The image forming system 1 can set the predetermined third threshold in order to confirm that the amount of used foil pressing toner is not as much as beyond a usable degree for forming a normal image. The predetermined third threshold may be set as the amount of foil pressing toner exceeding the usable degree for forming an image to be foil-pressed, such as a value corresponding to a coverage of 30%, or may be changed depending on the contents of image data.

When the amount of used non-foil pressing toner is the predetermined fourth threshold or less in the normal mode, the image forming system 1 interrupts the image forming operation based on image data. When forming an image based on image data in the normal mode, the image forming system 1 can determine whether the image data is normal image data on the basis of the amount of used non-foil pressing toner. The image forming system 1 can determine matching between the print mode and the image data on the basis of the amount of used non-foil pressing toner in not only the foil pressing mode but also the normal mode. When determining that the print mode mismatches with image data, the image forming system 1 does not perform a post-processing in the post-processing apparatus 40. Consequently, the image forming system 1 does not need to perform a post-processing such as stapling processing or punching processing on a user-unintended printed material.

The predetermined fourth threshold is set in the following viewpoints. The image forming system 1 can set the predetermined fourth threshold in order to confirm that the amount of used non-foil pressing toner is more than the amount of used non-pressing toner substantially usable for forming a normal image. On the basis of the assumption, the predetermined fourth threshold may be set as the amount of non-foil pressing toner substantially usable for forming a normal image, such as a coverage of 0.1%, or may be changed depending on the contents of image data.

The predetermined fourth threshold can be set per non-foil pressing toner. For example, it is assumed that when forming a normal image mainly including a text, the amount of black toner among yellow, magenta, cyan and black is the maximum and the amounts of used toners other than black are less or little. When such an image is formed in many cases, the image forming system 1 sets the fourth threshold of black toner to be higher and sets the fourth threshold of the toners other than black to be lower, thereby accurately determining user's image data. Thus, the image forming system 1 can set the fourth threshold per non-foil pressing toner, thereby enhancing an accuracy of the processing on image data.

The image forming system 1 can receive a user operation of selecting whether to cause the image data analysis unit to analyze image data. When the user selects not causing the image data analysis unit to analyze image data, the image forming system 1 does not analyze image data. Thus, the image forming system 1 can switch whether to analyze image data in response to a user operation, thereby optimizing the processing depending on user's desire.

When single-color print or monochrome print is designated for image data in the foil pressing mode, the image forming system 1 can receive a user operation of selecting whether to cause the image data analysis unit to analyze image data. When the user selects not causing the image data analysis unit to analyze image data for which single-color print or monochrome print is designated, the image forming system 1 does not analyze image data. When single-color print or monochrome print is designated in a print job received in the foil pressing mode, the image forming system 1 may determine that the image data is likely to be image data to be foil-pressed without analyzing the image data. Thus, the image forming system 1 can optimize the processing by omitting the processing of analyzing image data in response to a user operation.

When setting not to analyze image data (disabling the data analysis function), the image forming system 1 forms an image based on image data. The image forming system 1 can perform the basic processing as image forming apparatus, and can realize the present embodiment without the need to analyze image data and losing user's usability.

When determining to interrupt the image forming operation based on image data, the image forming system 1 issues a warning including warning display to the user. The image forming system 1 can rapidly issue a warning to interrupt the image forming operation to the user, thereby enhancing user's convenience.

Warning display by the image forming system 1 includes at least one of display as to whether the foil pressing operation is selected, file name including image data, and thumbnail display of the image data. The image forming system 1 can rapidly present, to the user, the information on image data for which the image forming operation is determined to interrupt, thereby further enhancing user's convenience.

When a print job includes a plurality of pages of image data, the image forming system 1 analyzes the image data per page. When there is a page for which the image forming operation based on the image data is determined to interrupt, the image forming system 1 terminates the processing. Thus, in this case, the image forming system 1 determines not to continue the image forming operation based on all the image data included in the subsequent pages in the print job. When there is a page for which the image forming operation is determined to interrupt, the image forming system 1 determines that the print mode is likely to mismatch with the image data in the subsequent pages, and rapidly terminates the processing, and thus a useless processing does not need to be performed.

An exemplary procedure of the processing in the image forming system 1 has been described according to the embodiment. However, the present embodiment is not limited thereto. Various changes and modifications as described below may be made.

According to the present embodiment, the image forming system 1 determines whether to proceed to the processing in step S106 on the basis of the processing in steps S102 to S104. However, the present embodiment is not limited thereto. The image forming system 1 may omit part or all of the processing in steps S102 to S104. For example, when all of the steps S102 to S104 are omitted, the image forming system 1 receives a print job in step S101, and then proceeds to the processing in step S106. In this case, the image forming system 1 analyzes the image data included in all the received print jobs. Further, steps S103 and S104 may be omitted, and the image forming system 1 may proceed to the processing in S106 to analyze the image data in the case of YES in step S102 or when the data analysis function is enabled. The image forming system 1 can arbitrarily change the condition to proceed to the processing in step S106 and can optimize the processing depending on user's desire, use environment, or the like.

The image forming system 1 sets the print mode at the foil pressing mode and confirms whether the data analysis function is exceptionally disabled in step S104, but the present embodiment is not limited thereto. The image forming system 1 may not confirm whether the data analysis function is exceptionally disabled and may confirm only whether the print mode is set at the foil pressing mode. Thereby, when single-color print or monochrome print is designated in the image data and the foil pressing mode is set, the image forming system 1 forms an image without analyzing the image data. When single-color print or monochrome print is designated in a print job received in the foil pressing mode, the image forming system 1 may determine that the image data is likely to be image data to be foil-pressed without analyzing the image data. In this case, the image forming system 1 can simplify the processing by changing the processing in step S104.

According to the present embodiment, in the case of NO in step S202 in the foil pressing mode, the image forming system 1 performs the processing in step S203. When in the case of NO in step S206 in the normal mode, the image forming system 1 performs the processing in step S207. However, the present embodiment is not limited thereto. The order of the processing in steps S202 and S203 may be changed or any of them may be omitted. For example, when step S203 is omitted, the control unit 21 proceeds to the processing in step S205 in the case of NO in step S202. Similarly, the order of the processing in steps S206 and S207 may be changed or any of them may be omitted. Consequently, the image forming system 1 can optimize the processing depending on user's desire, use environment, or the like.

According to the present embodiment, the image forming system 1 displays the items to be selected by the names of "foil pressing operation," "data analysis function," and the like on the operation screen illustrated in FIG. 5, but the present embodiment is not limited thereto. For example, "data analysis function" may be displayed in the name of "warning function."

According to the present embodiment, the image forming system 1 displays the operation screen illustrated in FIG. 5 on the operation panel 25. However, the present embodiment is not limited thereto. The operation screen may be displayed on a display of user's PC, and the image forming system 1 may receive various user operations on the operation screen from the user's PC. The operation screen may be displayed in combination with the setting screen for print jobs in PC and the like, for example.

According to the present embodiment, when determining to interrupt the image forming operation, the image forming system 1 discharges the sheet 50 forming an image thereon to a different sheet discharging unit from the normal sheet discharging unit 45. However, the present embodiment is not limited thereto, and a trash box for collectively discarding unrequired sheets may be provided in the image forming system 1. When determining to interrupt the image forming operation, the image forming system 1 may discard the sheet 50 on which an image is formed by the image forming unit 27 into the trash box.

According to the present embodiment, the description has been made assuming that the image forming system 1 causes the image data analysis unit 241 to analyze image data while or after causing the image forming unit 27 to form an image. As described above, however, the image forming system 1 may cause the image data analysis unit 241 to analyze image data before causing the image forming unit 27 to form an image. In this case, when determining to interrupt the image forming operation, the image forming system 1 can cause the image forming unit 27 not to form an image. The image forming system 1 can interrupt a processing more earlier than analyzing image data while or after causing the image forming unit 27 to form an image, and can avoid waste of expensive foil, staples in post-processing, or sheets.

(Variant)

A variant of the present embodiment will be described below with reference to the drawings.

According to the variant of the present embodiment, the image forming system 1 performs an additional processing of continuing a print job when issuing a warning.

Figure 9:
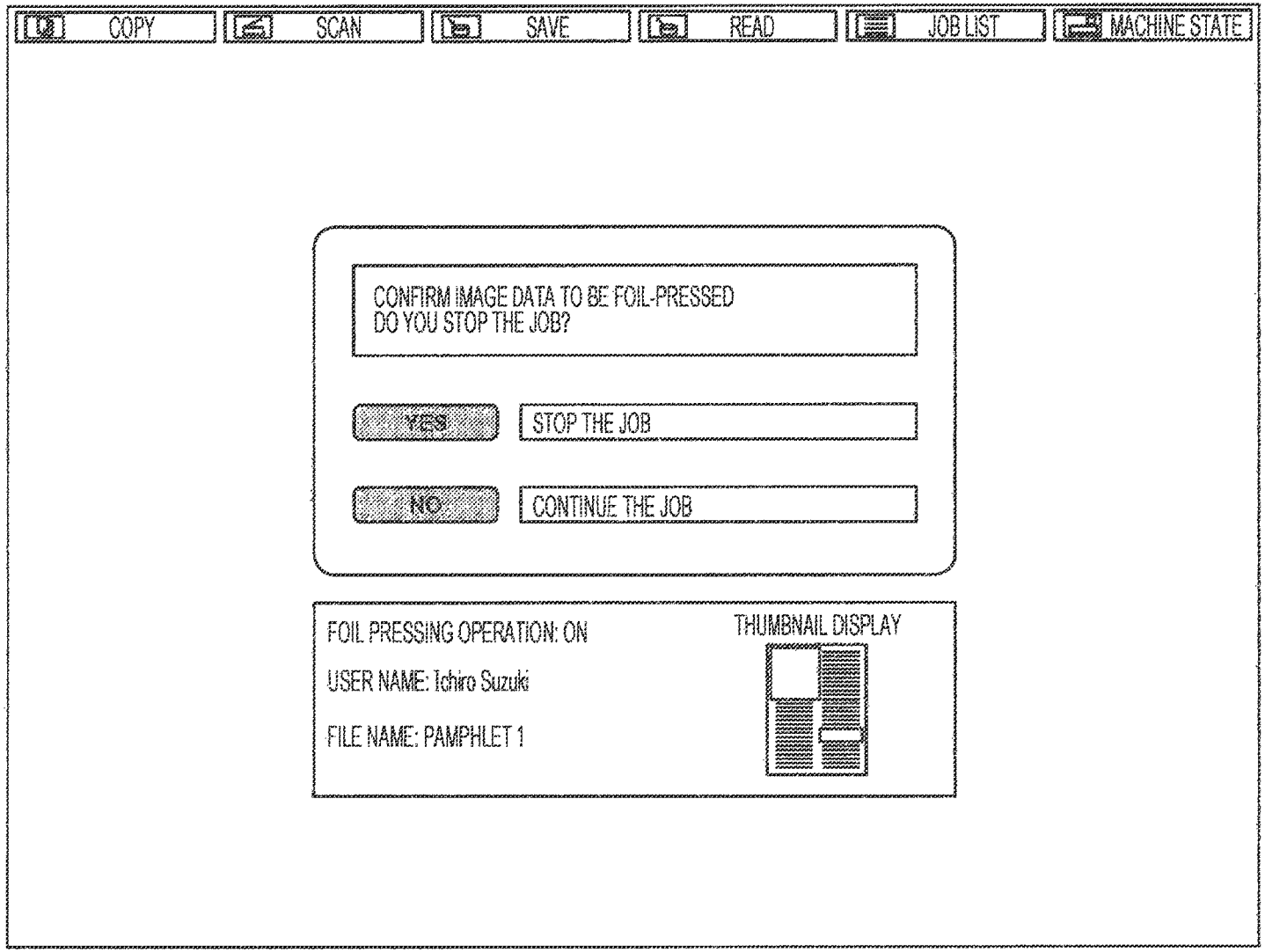
FIG. 9 is a diagram illustrating exemplary warning display displayed on the operation panel in the processing in step S121 in FIG. 8.

FIG. 8 is a flowchart illustrating a procedure of processing performed in the image forming system according to the variant. FIG. 9 is a diagram illustrating exemplary warning display displayed on the operation panel in the processing in step S121 in FIG. 8.

Steps S101 to S109 in FIG. 8 are similar to the processing in the same step numbers in FIG. 4, and thus the description thereof will be omitted.

When determining to interrupt the image forming operation in step S108 (step S108: NO), the control unit 21 as the warning unit 216 issues a warning including warning display to the user (step S121).

As illustrated in FIG. 9, the control unit 21 as the warning unit 216 displays warning display to the user on the operation panel 25 or the like via the display control unit 211. The warning display includes a message indicating the contents of a warning such as "confirm image data to be foil-pressed." According to the present variant, the warning display further includes a message for causing the user to determine whether to stop a print job such as "do you stop the job?" The control unit 21 as the operation reception unit 212 then receives a user instruction to select "continue print job or not" or "continue image forming operation based on image data for warning display or not" on the operation panel 25. According to the present variant, the control unit 21 receives an operation of selecting the "YES" or "NO" button thereby to receive a user instruction.

When not receiving a user instruction to continue the image forming operation (step S122: NO), the control unit 21 as the determination unit 215 determines to interrupt the image forming operation based on image data analyzed by the image data analysis unit 241 (step S123). The control unit 21 then terminates the processing.

In step S122, the control unit 21 may wait for the received user instruction. Alternatively, there may be configured such that when a standby time is restricted and the predetermined time is exceeded, the control unit 21 automatically proceeds to step S123.

On the other hand, when receiving a user instruction to continue the image forming operation (step S122: YES), the control unit 21 as the determination unit 215 determines to continue the image forming operation based on all the image data included in the subsequent pages in the print job (step S124). The control unit 21 then terminates the processing.

As described above, the image forming system 1 according to the variant receives a user instruction to select whether to continue the image forming operation based on image data for warning display. When receiving a user instruction to continue the image forming operation, the image forming system 1 continues the image forming operation based on the image data. Thus, also when determining to interrupt the image forming operation, the image forming system 1 can continue the print job when the user determines that there is no problem on forming an image. Consequently, the image forming system 1 can decrease the time to perform printing again, thereby enhancing user's convenience.

Even when there is a page for which the image forming operation is determined to interrupt, the image forming system 1 continues the image forming operation based on all the image data included in the subsequent pages in the print job when receiving a user instruction to continue the image forming operation. Thus, when the user determines that there is no problem on forming an image, the image forming system 1 can continue all the image forming operations included in the subsequent pages, and thus the user can omit the time to individually make an instruction to the image data included in the subsequent pages.

According to the variant, when receiving a user instruction to continue the image forming operation in step S122, the image forming system 1 continues the image forming operation based on all the image data included in the subsequent pages in the print job. However, the present variant is not limited thereto. In the case of YES in step S122, the image forming system 1 may proceed to the processing in step S109. In this case, when next image data is present in the print job, the image forming system 1 returns to the processing in step S106 thereby to analyze the image data included in the subsequent pages. Thus, the image forming system 1 can correspond to a user request to individually analyze image data per page.

The description has been made above assuming that the image forming apparatus 20 and the like in the image forming system 1 are as one apparatus according to the present embodiment. However, the present invention is not limited thereto. For example, an information processing apparatus for performing an image forming interruption determination processing and the like, and an apparatus for performing image forming may be separately configured for the image forming apparatus 20. In this case, the information processing apparatus and the apparatus for performing image forming are connected with each other via a bus.

The processing by the image forming system 1 according to one or more embodiments of the present invention can be realized by a dedicated hardware circuit for performing each procedure described above or by the CPU for executing the programs describing the procedures therein. When the embodiment is realized in the latter manner, the programs for operating the sheet feeding apparatus 10, the image forming apparatus 20, the foil pressing apparatus 30, and the post-processing apparatus 40 may be provided via a computer readable recording medium such as USB memory, floppy (trademark) disc, or CD-ROM, or may be provided online via a network such as Internet. In this case, the programs recorded in a computer readable recording medium are generally transferred and stored in a memory or hard disc. The programs may be provided as single application software, or may be incorporated in software as one function of the sheet feeding apparatus 10, the image forming apparatus 20, the foil pressing apparatus 30, and the post-processing apparatus 40.

Although embodiments of the present invention has been described and illustrated in detail, it is clearly understood that the same is by way of illustrated and example only and is not to be taken by way of limitation, the scope of the present invention being interpreted by terms of the appended claims.

What is claimed is:

1. An image forming system for transferring foil onto an image to be foil-pressed formed by a toner thereby to perform foil pressing print, comprising:

an image forming unit that forms a normal image or the image to be foil-pressed on a recording material using at least one of a plurality of toners based on image data;

an operation reception unit that receives an operation of selecting a foil pressing mode that causes the image forming unit to form the image to be foil-pressed or a normal mode that causes the image forming unit to form the normal image;

an image data analysis unit that analyzes the image data and acquires the amount of each toner used for forming the image based on the image data; and a determination unit that determines whether to interrupt the image forming operation based on the image data based on an amount of each used toner acquired by the image data analysis unit, wherein when the amount of toner not used for the image to be foil-pressed is a predetermined first threshold or more based on the amount of each used toner acquired by the image data analysis unit in the foil pressing mode, the determination unit determines to interrupt the image forming operation based on the image data.

2. The image forming system according to claim 1, wherein the predetermined first threshold is set per toner not used for the image to be foil-pressed.

3. The image forming system according to claim 1, wherein when the amount of toner used for the image to be foil-pressed is a predetermined second threshold or less based on the amount of each used toner acquired by the image data analysis unit in the foil pressing mode, the determination unit determines to interrupt the image forming operation based on the image data.

4. The image forming system according to claim 1, wherein when the amount of toner used for the image to be foil-pressed is a predetermined third threshold or more based on the amount of each used toner acquired by the image data analysis unit in the normal mode, the determination unit determines to interrupt the image forming operation based on the image data.

5. The image forming system according to claim 1, wherein when the amount of toner not used for the image to be foil-pressed is a predetermined fourth threshold or less based on the amount of each used toner acquired by the image data analysis unit in the normal mode, the determination unit determines to interrupt the image forming operation based on the image data.

6. The image forming system according to claim 5, wherein the predetermined fourth threshold is set per toner not used for the image to be foil-pressed.

7. The image forming system according to claim 1, wherein the operation reception unit receives a user operation of selecting whether to cause the image data analysis unit to analyze the image data, and when the operation reception unit selects not causing the image data analysis unit to analyze the image data, the image data analysis unit does not analyze the image data.

8. The image forming system according to claim 7,
wherein when selecting causes the image data analysis unit to analyze the image data, the operation reception unit receives a user operation of further selecting whether to cause the image data analysis unit to analyze the image data only when the foil pressing mode is set and single-color print or monochrome print is designated for the image data, and
when the operation reception unit selects not to cause the image data analysis unit to analyze the image data for which single-color print or monochrome print is designated, the image data analysis unit does not analyze the image data for which single-color print or monochrome print is designated.

9. The image forming system according to claim 1,
wherein in the foil pressing mode,
when full-color print is designated for the image data, the image data analysis unit analyzes the image data, and
when single-color print or monochrome print is designated for the image data, the image data analysis unit does not analyze the image data.

10. The image forming system according to claim 7,
wherein when the image data analysis unit does not analyze the image data, the image forming unit forms an image based on the image data.

11. The image forming system according to claim 1,
wherein the determination unit further includes a warning unit that issues a warning including warning display to a user when determining to interrupt the image forming operation based on the image data.

12. The image forming system according to claim 11,
wherein the warning display displays as to whether the foil pressing mode is set, and displays at least one of a file name including the image data and thumbnail display of the image data.

13. The image forming system according to claim 11,
wherein the operation reception unit receives a user instruction to select whether to continue the image forming operation based on the image data for the warning display, and
when determining to interrupt the image forming operation based on the image data, the determination unit continues the image forming operation based on the image data for the warning display when the operation reception unit receives a user instruction to continue the image forming operation based on the image data.

14. The image forming system according to claim 13,
wherein when a plurality of pages of the image data are included in a print job,
the image data analysis unit sequentially analyzes the image data per page, and
when there is a page for which the image forming operation based on the image data is determined to interrupt in the pages, the determination unit determines to continue the image forming operation based on the image data included in the subsequent pages to the page determined to interrupt when the operation reception unit receives a user instruction to continue the image forming operation based on the image data.

15. The image forming system according to claim 1,
wherein when a plurality of pages of the image data are included in a print job, the image data analysis unit sequentially analyzes the image data per page, and
when there is a page for which the image forming operation based on the image data is determined to interrupt in the pages, the determination unit determines not to continue the image forming operation based on the image data included in the subsequent pages to the page determined to interrupt.

16. An image forming method performed in an image forming system comprising an image forming unit that forms a normal image or an image to be foil-pressed on a recording material by use of at least one of a plurality of toners based on image data, and a foil pressing unit that transfers foil onto the image to be foil-pressed, the method comprising:
receiving an operation of selecting a foil pressing mode of causing the image forming unit to form the image to be foil-pressed or a normal mode of causing the image forming unit to form the normal image;
analyzing the image data and acquiring the amount of each toner used for forming an image based on the image data; and
determining whether to interrupt the image forming operation based on the image data and based on the amount of each used toner acquired in the analyzing step,
wherein when the amount of toner not used for the image to be foil-pressed is a predetermined first threshold or more based on the amount of each used toner acquired in the image data analysis step in the foil pressing mode, the image forming operation based on the image data is determined to interrupt in the determining step.

17. The image forming method according to claim 16,
wherein when the amount of toner used for the image to be foil-pressed is a predetermined second threshold or less based on the amount of each used toner acquired in the analyzing step in the foil pressing mode, the image forming operation based on the image data is determined to interrupt in the determining step.

18. The image forming method according to claim 16,
wherein when the amount of toner used for the image to be foil-pressed is a predetermined third threshold or more based on the amount of each used toner acquired in the image data analyzing step in the normal mode, the image forming operation based on the image data is determined to interrupt in the determining step.

19. The image forming method according to claim 16,
wherein when the amount of toner not used for the image to be foil-pressed is a predetermined fourth threshold or less based on the amount of each used toner acquired in the analyzing step in the normal mode, the image forming operation based on the image data is determined to interrupt in the determining step.

20. A non-transitory recording medium storing a computer readable program, the program executed by a computer in an image forming apparatus used in an image forming system comprising an image forming unit that forms a normal image or an image to be foil-pressed on a recording material by use of at least one of a plurality of toners based on image data, and a foil pressing unit that transfers foil onto the image to be foil-pressed, and the program causing the computer to perform:
receiving an operation of selecting a foil pressing mode of causing the image forming unit to form the image to be foil-pressed or a normal mode of causing the image forming unit to form the normal image;
analyzing the image data and acquiring the amount of each toner used for forming an image based on the image data; and
determining whether to interrupt the image forming operation based on the image data and based on the amount of each used toner acquired in the image data analyzing step, wherein when the amount of toner not used for the image to be foil-pressed is a predetermined first threshold or more based on amount of each used toner acquired in the image data analysis step in the foil pressing mode, the image forming operation based on the image data is determined to interrupt in the determining step.

21. The non-transitory recording medium storing a computer readable program according to claim 20, wherein when the amount of toner used for the image to be foil-pressed is a predetermined second threshold or less based on the amount of each used toner acquired in the analyzing step in the foil pressing mode, the image forming operation based on the image data is determined to interrupt in the determining step.

22. The non-transitory recording medium storing a computer readable program according to claim 20, wherein when the amount of toner used for the image to be foil-pressed is a predetermined third threshold or more based on the amount of each used toner acquired in the analyzing step in the normal mode, the image forming operation based on the image data is determined to interrupt in the determining step.

23. The non-transitory recording medium storing a computer readable program according to claim 20, wherein when the amount of toner not used for the image to be foil-pressed is a predetermined fourth threshold or less based on the amount of each used toner acquired in the analyzing step in the normal mode, the image forming operation based on the image data is determined to interrupt in the determining step.

* * * * *